United States Patent [19]

Stevens

[11] Patent Number: 4,748,699

[45] Date of Patent: Jun. 7, 1988

[54] WATER CLOSET LIMITED FLUSH VOLUME CONTROL SYSTEM

[76] Inventor: Charles F. Stevens, 19991 Wrightwood Ct., Yorba Linda, Calif. 92686

[21] Appl. No.: 51,297

[22] Filed: May 15, 1987

[51] Int. Cl.[4] ..... E03D 1/14; E03D 3/12

[52] U.S. Cl. ..... 4/324; 4/325; 4/345; 4/381; 4/415

[58] Field of Search ..... 4/325, 324, 415, 389, 4/390, 391, 384–385, 378, 380, 381, 395, 405, 249

[56] References Cited

U.S. PATENT DOCUMENTS

| | | | |
|---|---|---|---|
| 2,532,977 | 12/1950 | White | 4/325 |
| 3,538,519 | 11/1970 | Weisz | 4/325 |
| 3,839,746 | 10/1974 | Kowalski | 4/325 |
| 4,032,997 | 7/1977 | Phripp et al. | 4/324 X |
| 4,135,262 | 1/1979 | Overbey | 4/325 |
| 4,216,555 | 8/1980 | Detjen | 4/325 |
| 4,651,359 | 3/1987 | Battle | 4/415 X |

*Primary Examiner*—Henry K. Artis

*Attorney, Agent, or Firm*—Allen A. Dicke, Jr.

[57] ABSTRACT

A float is slidably mounted on the upright overflow tube or other upright guide in the toilet tank. As the water level lowers during flushing, the float descends so that a valve actuator on the bottom of the float closes the flapper valve when the water level is partway down the tank, to conserve flush water.

When it is desired that the user have a choice between a limited flush for the flushing of liquids and a full flush, a hook is provided so that it can be manipulated to engage the float to hold the float in its raised, non-actuating position. By manipulation of the flush handle, the hook on the flush lever can be moved between the float-engaging and the float non-engaging position.

23 Claims, 3 Drawing Sheets

WATER CLOSET LIMITED FLUSH VOLUME CONTROL SYSTEM

BACKGROUND OF THE INVENTION

This invention is directed to a water closet limited flush volume control system for conserving flush water and to an optional system wherein the user can manipulate a handle on the toilet to select sufficient flush water volume for either a full flush or a partial flush. By utilization of the control system, water is conserved.

Most toilet installations include a tank mounted above the toilet bowl. A bottom outlet in the tank permits water to flow from the tank to the bowl. A hinged flapper valve normally overlies the outlet so that the tank can be filled. Filling is accomplished to a predetermined level by means of an inlet valve which controls water inflow from a pressurized source. A float controls the valve to shut off the valve when the selected water level is reached. An overflow tube is connected to the tank outlet and stands upright next to the outlet. The flapper valve is usually pivoted on the overflow tube. The overflow tube prevents the overfilling of the tank to the point of water spillage.

Toilets are normally designed so that a more than adequate amount of water is delivered to the bowl at each flush to adequately flush out the contents thereof even when there are solids present. A considerable amount of water can be saved by individually adjusting the amount of flush water discharged in each individual toilet to accommodate for its individual design and installation. This is called a limited flush wherein the minimum amount of water is employed to flush the toilet when there are solids present. More water can be conserved by permitting the user to select a smaller quantity of water to achieve a partial flush for use when only liquids are flushed. This problem has been recognized, and there is a considerable amount of prior art which attempts to conveniently achieve this objective. However, there is no reliable structure available which provides a flush volume control system which can be used as an after-market installation in conventional water tanks and can be economically and reliably provided in new equipment.

SUMMARY OF THE INVENTION

In order to aid in the understanding of this invention, it can be stated in essentially summary form that it is directed to a float configured to slide up and down an upright guide tube in a toilet tank. The float has a valve actuator on the bottom to close the flush flapper valve in the bottom of the tank before the descending water level reaches the flapper valve to close the flapper valve for a limited volume flush. The structure uniquely provides the required maximum available hydraulic head pressure throughout the entire limited flush cycle to render a complete flushing of the toilet bowl using only the absolute minimum quantity of water. In an embodiment of the invention, a hook can be manipulated to hold up the float to prevent its flapper valve closing to achieve a larger but still limited volume flush.

It is, thus, an object of this invention to provide a water closet variable flush volume control system whereby the user can select between a partial volume and a limited volume of toilet flush water so that water conservation can be achieved.

It is another object and advantage of this invention to provide a flush volume control system which is useful both in new equipment and in retrofitting existing toilet structures so that a reliable and economic volume control system can be readily achieved in existing standard toilets.

It is another object and advantage of this invention to provide a flush volume control system which is economic of construction, reliable in operation, and easily installed so that the water conservation advantages of the flush volume control system can be widely enjoyed.

Other objects and advantages of this invention will become apparent from a study of the following portion of the specification, the claims and the attached drawings.

DESCRIPTION OF THE PREFERRED EMBODIMENT

Figure 1:
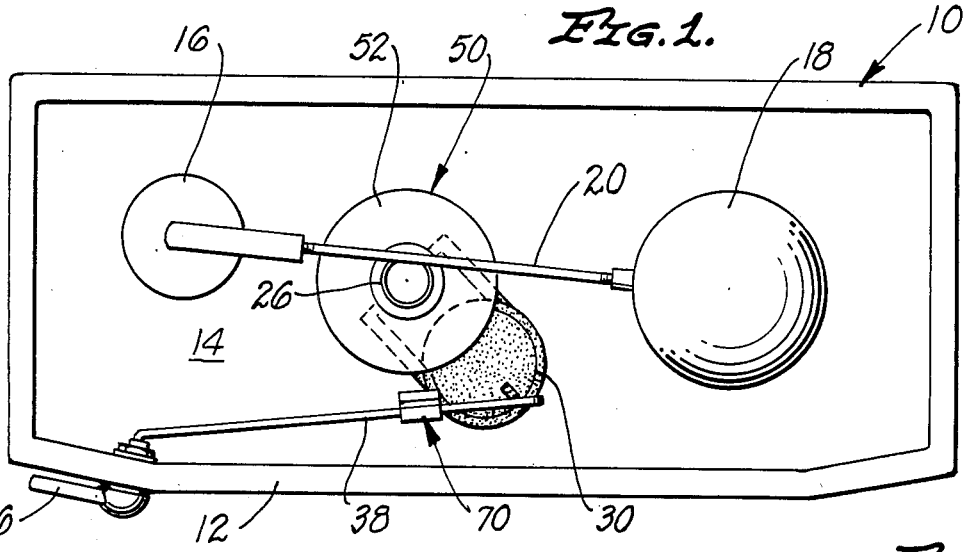
FIG. 1 is a plan view of a toilet tank, with cover removed, showing the water closet limited flush volume control system of this invention installed therein and positioned for a partial flush.
Figure 2:
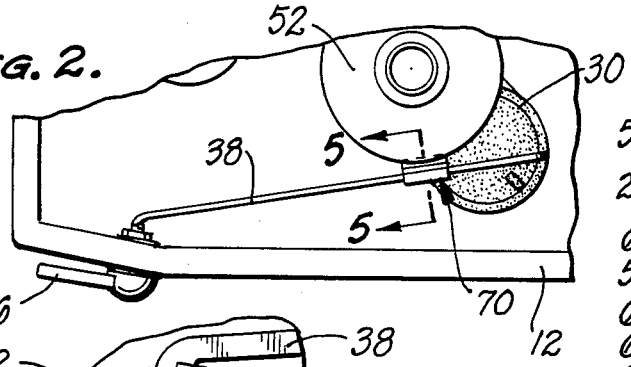
FIG. 2 is a view similar to FIG. 1, with parts broken away, showing the structure positioned for a limited volume flush.

Toilet tank 10 is a conventional toilet tank mounted on the back of and above a toilet bowl. Toilet tank 10 has end walls, a back wall, a front wall 12, and bottom 14. The walls and bottom are attached to provide an open top water container. The bottom is closed except for the water inlet and outlet. Water inlet control valve 16 is mounted on the top of the stand pipe that comes up through the bottom of the tank and is sealed with respect thereto. The stand pipe is connected to a source of water under pressure. The valve 16 is controlled by water inlet control float 18 on valve arm 20. When the water rises to a predetermined level, the float shuts off valve 16 to terminate water inflow.

Figure 4:
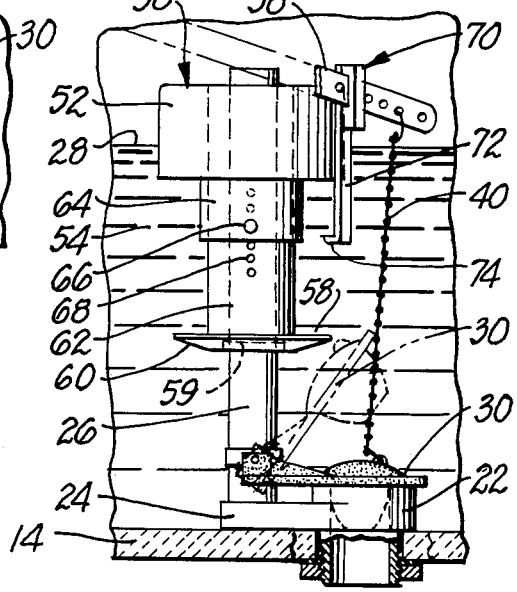
FIG. 4 is a front elevation of the tank, with the front wall and other parts broken away, showing the flush volume control system of this invention installed therein and ready for a toilet flush.

Water outlet fitting 22 extends through the bottom 14 of the tank, as is seen in FIG. 4, and is connected to permit the water passing therethrough to flow into the toilet bowl to flush the toilet bowl. Thus, the fitting 22 always has an outlet. Side arm 24 is mounted on the side of fitting 22 within the tank. The side arm 22 carries upright overflow tube 26 thereon. The top of the overflow tube is positioned to define a maximum water level within the tank. The normal "filled" level of the tank is defined by float 18 and may be adjusted, and is below the top of the overflow tube. The normal filled level 28 is shown as the top of the water in FIG. 4 and is shown as a dashed line in FIG. 6.

Outflow from the tank through outlet fitting 22 is controlled by flapper valve 30. Flapper valve 30 is formed of somewhat resilient material so that it can effect a seal with the top of the outlet fitting when in the closed position shown in FIGS. 4 and 6. The flapper valve has a pair of arms extending therefrom which pivot upon pivot pins mounted on the lower end of overflow tube 26. Flapper valve 30 is held in the closed position by means of gravity and water pressure. The flapper valve contains an air chamber so that, when the flapper valve is raised off its seat on the top of outlet fitting 22, the flapper valve floats in the water in the tank, in the position shown in dashed lines in FIG. 4. The flapper valve 30 is raised off of its seat to release water from the tank to cause flushing of the toilet bowl.

Bushing 32 extends through the front wall of the tank. It rotatably carries handle shaft 34 therein, see FIG. 3. Flush handle 36 is mounted on the exterior of the handle shaft 34 and flush lever 38 is mounted on handle shaft 34 within the tank. Flush chain 40 connects the flush lever with flapper valve 30 so that, when the flush handle 36 is pushed down, chain 40 pulls flapper valve 30 off of its seat. The air chamber in flapper valve 30 causes the flapper valve to float in the raised position shown in dashed lines in FIG. 4 until the lowering water level or the flush volume control system of this invention cause closure of the flapper valve.

Figure 6:
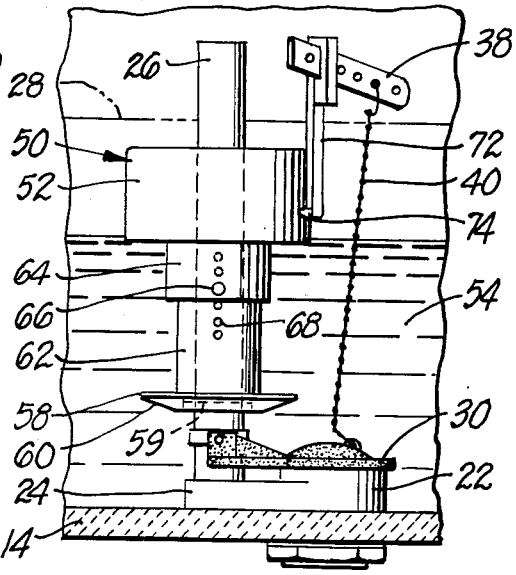
FIG. 6 is a view similar to FIG. 4, showing the closure of the flapper valve at the end of a limited volume flush.

Float assembly 50 is comprised of float 52 which is of generally cylindrical shape. The float is intended to float on the water 54 in the tank and thus is of lower density than the water. It may be a hollow float, a foam-filled float, or an inverted cup. Float 52 is illustrated as being generally in the form of a right-circular cylinder, which may be open on the bottom. Float 52 has a guide opening 56 on the interior thereof which is sized and shaped so that the float assembly can move up and down on the overflow tube 26 in accordance with the amount of water in the toilet tank. Extending down from the bottom of the float is valve actuator 58. Valve actuator 58 is in the form of a downwardly pointed truncated shallow cone with an actuator surface 60. As seen in FIG. 6, as the water level descends, the float assembly descends with the descending water level so that the actuator surface 60 engages on the top of flapper valve 30 to close the flapper valve with water still remaining in the tank. As the float assembly descends from the position of FIG. 4 to the position of FIG. 6, the angular actuator surface 60 first thrusts the flapper valve 30 away from the upright overflow tube and, as the float assembly descends, it thrusts the flapper valve sufficiently toward the closed position that the dynamic hydraulic effect of the downwardly flowing flush water overcomes the buoyancy of the flapper valve to thrust the flapper valve into the closed position shown in FIG. 6.

Valve actuator 58 is mounted on a stem 62 which is telescopically mounted in the guide 64 in float 52 so that the overall height of the float assembly can be adjusted. The interengagement between the stem 62 and the guide 64 can be of any convenient adjustable structure, such as spiral screw thread, or by a pin engaging in selected holes. As illustrated in FIG. 4, pin 66 engages through guide 64 to engage in the selected hole in a series of holes 68 in stem 62. When the toilet is flushed, flapper valve 30 is raised to the open position shown in dashed lines in FIG. 4. As the water level descends, the float assembly 50 descends to close the flapper valve 30 when the water level is still above flapper valve 30. This closure is illustrated in FIG. 6. Actuator 58 has a recess 59 in the bottom around opening 56 so the recess can embrace the pivot on valve 50, if necessary, to close the flapper valve. In order to prevent the open flapper valve from hindering the descent of float 50, the conical surface 60 has a total included cone angle of about 140 degrees to force out the flapper valve as the float descends.

Such is sufficient structure to provide a flush of limited volume, with the same limited volume upon every flush. The amount of water discharged during this limited volume flush is controlled by the adjustment of stem 62 in guide 64 to thus control the overall distance between the floation level of the float assembly and its actuator surface 60. A more thorough flush with a lesser amount of water can be accomplished when the starting hydraulic head of water is high in the tank. Thus, it is desirable to have a maximum height of the normal filled level 18 at the start of the flush. In order to conserve water, the flush must be terminated before flapper valve 30 loses buoyance due to low water level in the tank. For this reason, adjustment may be provided so that the optimum limited amount of water can be discharged in each flush to accomplish satisfactory flushing of the toilet. No adjustment is necessary if the toilet tank and bowl parameters are known, but to fit a plurality of different toilet structures, initial adjustment is desirable for achieving a limited flush.

Figure 5:
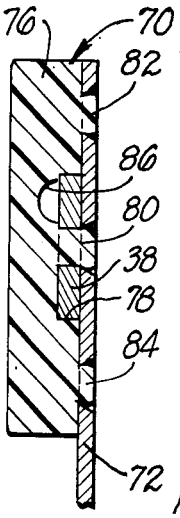
FIG. 5 is an enlarged section taken generally along line 5—5 of FIG. 2.
Figure 7:
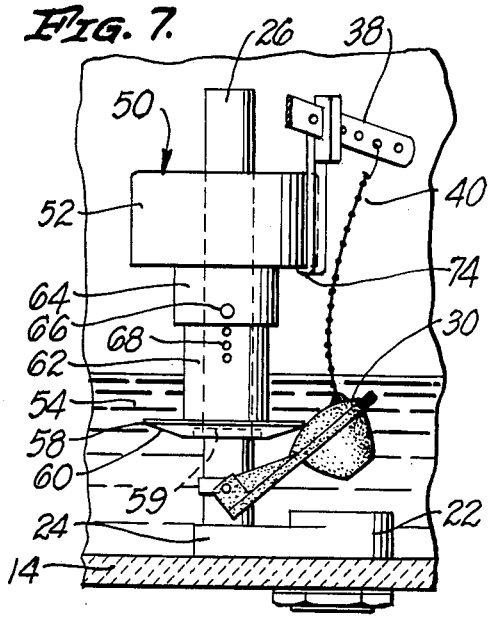
FIG. 7 is a view similar to FIG. 4, showing the positioning of the structure during the latter portion of a limited volume flush.

The structure thus described is satisfactory to provide a limited flush which has sufficient water volume to provide an adequate flush even when solids are involved. The structure uniquely provides the required maximum available hydraulic head pressure throughout the entire limited flush cycle to render a complete flushing of the toilet bowl using only the absolute minimum quantity of water. The structure thus far described provides for only one flush volume, albeit a limited, water-conserving flush volume. The same float can be employed with a float assembly holder to provide a user choice between a regular full volume flush and a partial flush of even less water than the previously described limited volume flush. In order to permit the regular full volume flush, float assembly holder 70 is provided. The float assembly holder is comprised of shank 72, which has a hook 74 at the lower end thereof and a shank holder 76 at the upper end thereof. Shank holder 76 has a slot 78 across the face thereof to receive the lever 38 together with a boss 80 in the slot to extend through one of the holes in the flush lever 38, as shown in FIG. 5. Additional bosses 82 and 84 extend into holes in the upright shank 72 to clamp the shank to the flush lever. The shank holder 76 has a slot 86 with a semi-circular bottom therein as part of the slot 78. The slot 86 is for those cases where the flush lever 38 is of circular cross section, as compared to the rectangular cross section shown. The shank holder retains the shank and hook of the float assembly holder in place on the flush lever. The hook is of such length and is positioned with respect to the float 52 that, when a full volume flush is desired, handle 36 can be manipulated to swing flush lever 38 closer to float 52 so that the hook 74 engages under float 52, as shown in FIG. 7. It is seen that, without lateral manipulation of the handle 36, the hook 74 lies just clear of the float. However, with the manipulation of the handle, the hook 74 engages the float to hold the float in an upper position where it does not press down upon flapper valve 30. The flapper valve 30 is buoyant so that it stays raised until the water level falls to the flapper valve to permit it to close after a full-volume flush.

Figure 3:
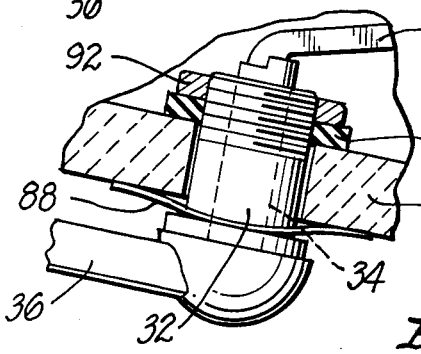
FIG. 3 is an enlarged section through the mounting of the flush lever in the front wall of the toilet tank.

In normal circumstances, the handle shaft 34 is sufficiently loose within bushing 32 to permit the amount of manipulation required to cause hook 74 to engage or not engage. However, should more flexibility be required, the bushing 32 can be loosely mounted within the front wall of the toilet tank. As seen in FIG. 3, the bushing passes through the front wall 12 of the toilet tank, and, in this special embodiment, a C-shaped generally flat spring 88 is embraced around bushing 32, under its head on the outside of front wall 12. On the inside of the tank, rubber washer 90 is retained in place by nut 92, which controls the deflection of spring 88. When nut 92 is a nylon washer or a nylon locked nut, there is no tendency for it to loosen. With this structure, lateral manipulation of handle 36 not only causes motion of shaft 34 within bushing 32, but also causes motion of the bushing 32 within the opening in the front wall of the toilet tank. In this way, more lateral motion is achieved at float assembly holder 70. More than enough motion is available to easily engage the hook 74 under the lower edge of the float or to clearly leave the float free of the hook.

Figure 8:
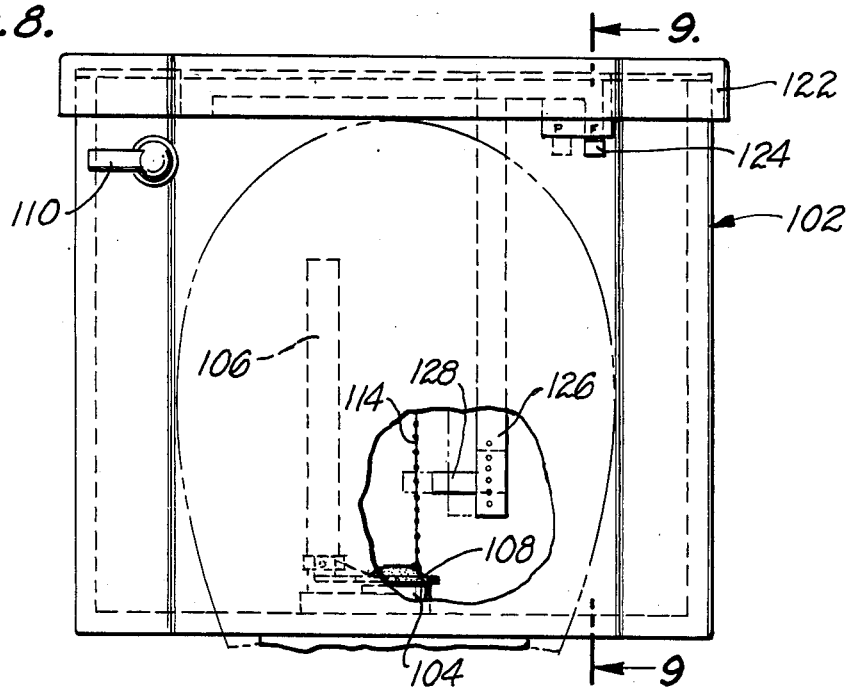
FIG. 8 is a front elevation view of a toilet tank containing the second preferred embodiment of the limited volume flush control system of this invention.
Figure 9:
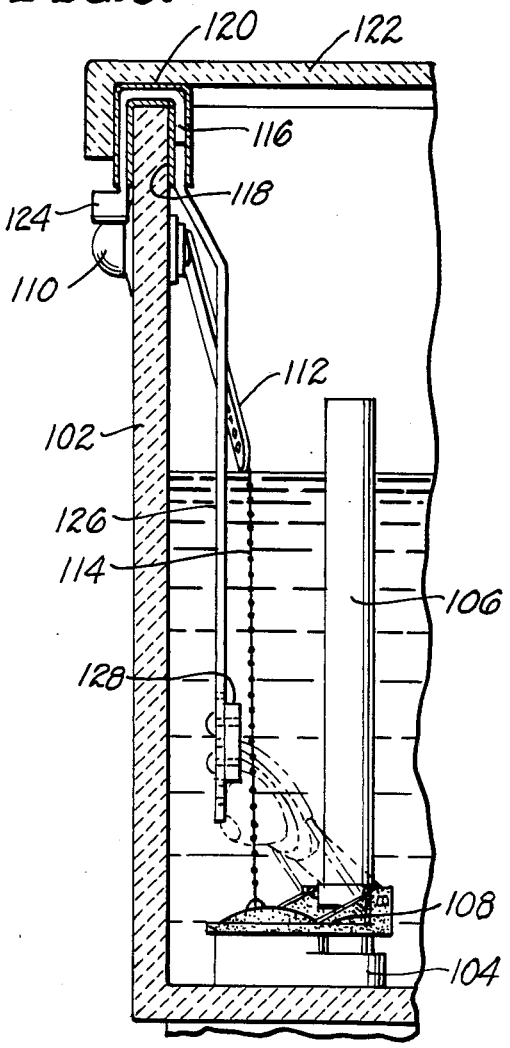
FIG. 9 is an enlarged section taken generally along the line 9—9 of FIG. 8.

FIGS. 8 and 9 show toilet tank 102 which has the conventional flush water outlet fitting 104 and its overflow stand pipe 106. Flapper valve 108 is pivoted on the stand pipe and is raised by flush handle 110 which raises flush lever 112 and pulls flush chain 114 which is connected to flapper valve 108. This is the same structure as described with respect to toilet tank 10. In the species of that structure wherein the hook was provided to selectively restrain the float assembly, freedom in the flush handle and supporting structure is employed to transmit motion from the exterior to the interior of the tank. In the species of FIG. 8, this connection between exterior and interior motion is provided by means of U-shaped slider 116, see FIG. 9, which engages over the front of the tank at its top edge. In order to permit ease of sliding, inverted U-shaped interior guide 118 is embraced over the top edge of the tank and exterior guide 120 is embraced over slider 116. This structure provides space for slider 116 and raises the tank cover 122 sufficiently to permit ease of operation. Spacers may be employed under the tank cover at other locations to maintain level of the tank cover. Slider 116 has an exterior finger engageable slide handle 124 and an interior control lever 126. When the control lever 126 is slid from left to right, stop 128 thereof, when in the left position, can engage under the float assembly 50 to hold it up and prevent it from closing flapper valve, in the same way as accomplished by hook 74.

Stop 128 may be used in a different manner to also control flushing. As shown in FIG. 8, stop 128 can be moved from the full line position where it is out of the way of the raising of flapper valve 108 to a point shown in dashed lines where it is in the path of the raising motion of the flapper valve 108. In the latter position, it permits raising the flapper valve by its chain 114 a sufficient distance to permit outflow of flushing water from the tank, but an insufficient distance to permit the flapper valve 108 to remain in its open position by virtue of its flotation. When the amount of opening is limited to that illustrated in FIGS. 8 and 9, the hydraulic force of the outflowing water overcomes the buoyancy of the flapper valve 108 and thus, when the chain is released, the flapper valve is forced to the closed position by the outflowing water. In this way, flush water flows out of the tank only so long as the flush handle is depressed. A limited flush can be accomplished by judgment of the user.

Figure 10:
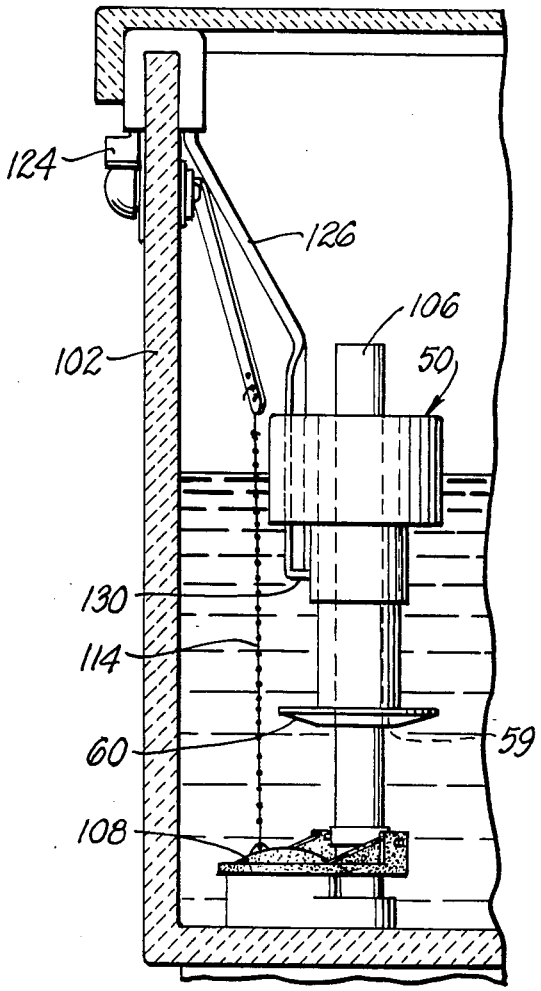
FIG. 10 is a section similar to FIG. 9, but showing at third preferred embodiment of the limited volume flush control system of this invention.

FIG. 10 shows the tank 102 with its manually operable slide handle 124 in connection with the float assembly 50 on overflow tube 106. As described with respect to FIGS. 4, 6 and 7, float valve 50, unless restrained, closes flapper valve 108 before the water level descends sufficiently far to permit the loss of flotation of flapper valve 108 to close it due to low water level. Restraint of float assembly 50 is accomplished by hook 130 on control level 126. In this way, when the hook engages the float assembly, it holds the float assembly up and permits a full flush. When the hook does not engage the float assembly, the float assembly moves down with descending water level so that surface 60 forces the flapper valve 108 down toward its seat sufficiently far that the hydraulic forces of the outflowing water close the flapper valve to stop the flush. Thus, selection can be made between full and partial flush by manual control of slide handle 124.

Figure 11:
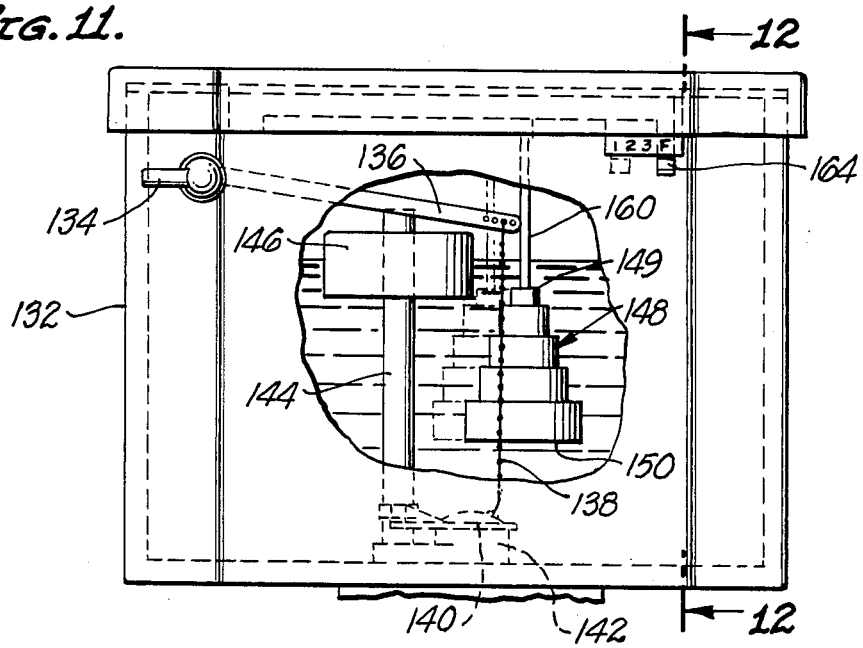
FIG. 11 is a front-elevational view of a toilet tank, with parts broken away, showing a fourth preferred embodiment of the limited flush volume control system of this invention.
Figure 12:
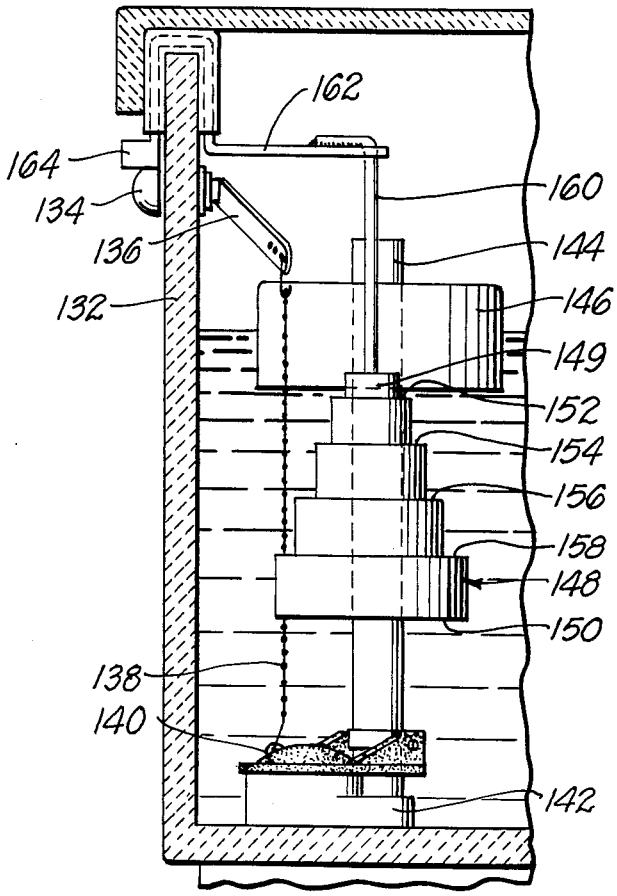
FIG. 12 is an enlarged section taken generally along the line 12—12 of FIG. 11.

Toilet tank 132, seen in FIGS. 11 and 12, is a tank similar to tank 12 shown in FIG. 1 and tank 102 shown in FIGS. 8, 9 and 10. Tank 132 has a flush handle 134 which actuates a flush lever 136 which is connected to flush chain 138, which raises flapper valve 140 off of its seat on its outlet fitting 142. The outlet fitting has an overflow stand pipe 144 thereon. Float 146 floats freely up and down the stand pipe, controlled by the water level on the tank, and in this sense is similar to float 52 of float assembly 50.

Valve actuator 148 is free to float up against stop 149 with minimum buoyancy with its top step 152 just under float 146 at tank-full water level. Float 146 has sufficient weight during its descent with decreasing water level to lower both float 148 and the flapper valve 140. The vertical spacing of the steps is predetermined to assure clearance for the full unobstructed operation of the flapper valve in minimum tank volume toilets.

Valve actuator 148 has an actuator surface 150 which is flat on the bottom since it engages the flapper valve from the other side. Valve actuator 148 has a series of steps on the upper surface thereof. The steps are in the form of cylindrical sections of the valve actuator, with each higher section of smaller diameter to provide the upwardly facing steps shown in FIGS. 11 and 12. Steps 152, 154, 156 and 158 are shown. The curved surfaces are all formed about the central axis. There is a central axial opening upright through the valve actuator. Guide rod 160 passes downward into the central axial opening to guide valve actuator 148 in the up and down direction within the tank. Valve actuator 148 has slight buoyancy so that it tends to rise in the water to keep it against stop 149 above flapper valve 140, unless forced downward.

Guide rod 160 is mounted on control lever 162 which is controlled by slide handle 164. This construction is similar to that illustrated and described in FIGS. 8, 9 and 10. In this way, rod 160 can be moved from left to right. In its right position shown in full lines in FIG. 11, the lowest step 158 is engaged by downwardly moving float 146 so that flapper valve 140 is closed after flow of the largest selected volume of flush water. When guide rod 160 is moved to its leftmost position, descending float 146 engages upon the topmost step 152 which thrusts valve actuator 148 downward so that its actuator surface 150 moves flapper valve 140 sufficiently closed that the hydraulic force of the outflowing water closes the flapper valve on its seat. This is a flush with minimum outflow of water. The four steps on the valve actuator permit the user to select four different volumes of limited or partial flush, as well as the full flush.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A limited flush volume control system for a toilet having a tank with a freely upswinging flapper valve which permits unrestricted outflow from the bottom of the tank when raised and having an upstanding overflow tube adjacent the valve, comprising:

a float assembly mounted on the overflow tube for movement up and down the overflow tube;

a float on said float assembly so that said float assembly moves up and down the overflow tube in accordance with water level in the tank;

a valve actuator on said float assembly, said valve actuator having a lower face in the form of a shallow truncated cone with its apex directed downward towards the flapper valve, said valve actuator being positioned to have its conical surface engage and close the freely upswinging flapper valve as the water level moves down in the toilet tank, said float assembly being sized and configured so that said valve actuator closes the flapper valve at an intermediate water level in the toilet tank to provide a limited volume flush.

2. The system of claim 1 further including a float assembly holder, said float assembly holder having means thereon for restraining descent of said float assembly so that said valve actuator on said float assembly does not close the flapper valve, but lowering of water in the tank substantially to the level of the flapper valve closes the flapper valve to provide a full-volume flush.

3. The system of claim 2 wherein said float assembly holder is manually manipulatable so that the user can select between a limited volume flush and a full volume flush by manipulating said float assembly holder out of or into engagement with said float assembly.

4. The system of claim 3 wherein said float assembly holder comprises a hook for mounting on the flush lever of a toilet so that manipulation of the toilet flush handle moves the toilet flush lever to move said hook into and out of float assembly engaging position.

5. The system of claim 4 wherein said valve actuator is adjustably mounted on said float so that the height of said valve actuator with respect to said float is selectable to select the volume of a limited volume flush.

6. The system of claim 5 wherein said valve actuator is a disc mounted upon a stem and said stem is telescopically mounted with respect to a guide on said float, said stem being positionable in a selected position with respect to said guide to position said disc with respect to said float.

7. The system of claim 6 wherein a guide opening extends through said valve actuator, said stem, said guide and said float, said guide opening being for slidable positioning on the overflow tube, said float and said valve actuator being concentric around said guide opening.

8. The system of claim 1 wherein said valve actuator is a disc which has a lower face in the form of a shallow truncated cone having a total included angle of about 140 degrees.

9. The system of claim 1 wherein the flapper valve is pivoted on a pin and said valve actuator has a recess in the bottom face thereof to receive the pivot pin of the flapper valve in the lowest position of the float assembly.

10. The system of claim 1 wherein said valve actuator is adjustably mounted on said float so that the height of said valve actuator with respect to said float is selectable to select the volume of a limited volume flush.

11. The system of claim 10 wherein said valve actuator is a disc mounted upon a stem and said stem is telescopically mounted with respect to a guide on said float, said stem being positionable in a selected position with respect to said guide to position said disc with respect to said float.

12. The system of claim 11 wherein a guide opening extends through said valve actuator, said stem, said guide and said float, said guide opening being for slidable positioning on the overflow tube, said float and said valve actuator being concentric around said guide opening.

13. The system of claim 12 wherein said valve actuator disc has a lower face in the form of a shallow truncated cone.

14. A limited flush volume control system for a toilet having a tank with a freely upswinging flapper valve pivoted on a pin to rise to float to permit outflow from the bottom of the tank and having an upstanding overflow tube carrying the pivot pin adjacent the valve, comprising:

a float assembly for mounting on the overflow tube for free movement up and down the overflow tube;

a float on said float assembly so that said float assembly moves up and down the overflow tube in accordance with increasing or decreasing water level in the tank;

a valve actuator on said float assembly, said valve actuator being positioned to engage and close the outflow control valve in the bottom of the tank as the water level moves down in the toilet tank, said valve actuator having a recess in the bottom thereof to permit said actuator to descend to the lowest position of said float assembly on the overflow tube, said float assembly being sized and configured so that the valve actuator closes the valve at an intermediate water level in the toilet tank to provide a limited volume flush.

15. The system of claim 14 wherein said valve actuator is in the form of an inverted truncated cone which engages the top of the raised flapper valve as water level moves down in the toilet tank to move the flapper valve toward closed position before the flapper valve closes due to loss of buoyancy due to low toilet tank water level.

16. The system of claim 15 wherein the flapper valve is pivoted on a pin and said valve actuator has a recess in the bottom face thereof to permit said actuator to descend to the lowest position of the float assembly.

17. The system of claim 15 wherein said truncated cone on said valve actuator has a total included angle of about 140 degrees.

18. A varible flush volume control system for installation in a toilet tank having an upright overflow tube adjacent a bottom outlet and a flapper valve for opening and closing the bottom outlet, together with a flush lever for raising the flapper valve to cause toilet flushing, said system comprising:

a float mounted for movement up and down the overflow tube in accordance with water level for indicating reduction in water level from a tank-full water level to a lower water level;

a valve actuator movable in the direction of movement of said float as water level reduces in the tank, said valve actuator having an actuator surface and having a plurality of positions at which it can be engaged by said float so as to be able to select the distance from said float to said actuator surface, said actuator surface being for engaging the flapper valve and forcing closed the flapper valve when the float indicates intermediate water level.

19. The system of claim 18 wherein said valve actuator and said float have a plurality of steps therebetween and said valve actuator is laterally adjustable with respect to said float so that said float engages on said actuator on a selected step so that the closure of the flapper valve can be selected at different intermediate water level positions.

20. The system of claim 18 further including means for restraining said float above the flapper valve and wherein said means for restraining said float assembly comprises a hook for mounting on the flush lever so that the flush lever can be manipulated to engage said hook on said float assembly to restrain said float assembly to provide a full volume flush and can be manipulated to be free of said float assembly to permit said float assembly to close said flapper valve at an intermediate water level to provide a limited volume flush.

21. A variable flush volume control system for installation in a toilet tank having an upright overflow tube adjacent a bottom outlet and a flapper valve for opening and closing the bottom outlet, together with a flush lever for raising the flapper valve to cause toilet flushing, said system comprising:

a float assembly mounted for movement up and down the overflow tube in accordance with the water level and in accordance with selection of a limited or full volume flush, said float assembly having a float adjacent the top thereof for indicating reduction in water level from a tank-full water level to an intermediate water level for a limited volume flush, said float assembly carrying on said float a valve actuator for engaging the flapper valve and forcing closed the flapper valve when the float indicates intermediate water level; and means for restraining said valve actuator above said flapper valve, comprising a handle separate from the flush handle for moving a stop into and out of position with respect to said float assembly so that when in position said float assembly is restrained from closing the flapper valve for permitting water level to decrease below the intermediate water level for a full volume flush.

22. A limited flush volume control system for a toilet having a tank with a flapper valve to control outflow from the bottom of the tank and having a flush handle to raise the flapper valve, said system comprising:

a separate finger engageable handle on the exterior of the tank, an interior control lever connected to be moved by the finger engageable handle, a stop on said control level, said stop being movable by motion of said finger engageable handle from the position where it is out of the way of the flapper valve so that the flapper valve may be raised to full flush position by actuation of the flush handle and movable to a position where said stop is above the flapper valve to limit the opening of the flapper valve such that actuation of the flush handle can raise the flapper valve against said stop but upon release of the flush handle hydraulic force of the outflowing water overcomes the buoyancy of the flapper valve to force the flapper valve closed by the force of the outflowing water so that flush water flows out of the tank only as long as the flush handle holds the flapper valve up against said stop.

23. The method of limiting the volume of water required by a toilet comprising the steps of:

mounting a float assembly on the overflow tube of a toilet having a float for floating freely on the water in the toilet tank and having a valve actuator at an adjustable position therebelow;

selecting the distance between the float and the valve actuator at which the valve actuator contacts the toilet flush flapper valve for a selected level of water in the toilet tank; and closing the toilet flush flapper valve by engagement by the valve actuator as the tank water level falls to the selected level before the flapper valve loses buoyancy to achieve a limited toilet flush.

* * * * *